US005695091A

United States Patent [19]

Winings et al.

[11] Patent Number: 5,695,091

[45] Date of Patent: Dec. 9, 1997

[54] AUTOMATED DISPENSER FOR DISINFECTANT WITH PROXIMITY SENSOR

[75] Inventors: Thomas R. Winings, Ellicott City, Md.; Robert Samson, Tucson, Ariz.

[73] Assignee: The Path-X Corporation, Ellicott City, Md.

[21] Appl. No.: 548,052

[22] Filed: Oct. 25, 1995

[51] Int. Cl.[6] ..... B67B 7/00

[52] U.S. Cl. ..... 222/1; 222/39; 222/52; 222/333

[58] Field of Search ..... 222/1, 52, 642, 222/25, 36, 39, 63, 305, 333, 361; 4/623

[56] References Cited

U.S. PATENT DOCUMENTS

| | | | |
|---|---|---|---|
| 3,273,752 | 9/1966 | Horeczky . | |
| 3,576,277 | 4/1971 | Blackmon . | |
| 3,650,435 | 3/1972 | Kleefeld . | |
| 4,882,567 | 11/1989 | Johnson . | |
| 4,938,384 | 7/1990 | Pilolla et al. | 222/52 |
| 4,942,384 | 7/1990 | Yamauchi et al. . | |
| 4,949,074 | 8/1990 | D'Ambrosia et al. . | |
| 4,972,978 | 11/1990 | DeLuca | 222/361 X |
| 5,130,613 | 7/1992 | Szuba . | |
| 5,136,213 | 8/1992 | Sacchetti . | |
| 5,344,047 | 9/1994 | Chen . | |
| 5,397,028 | 3/1995 | Jesadanont . | |

OTHER PUBLICATIONS

Larson, Elaine,; McGeer, Allison; Quraishi, Ahmed; Krenzichek, Dina; Parsons, B.J.; Holdford, Jack; Hierholzer, Walter J.; "Effect of an Automated Sink on Handwashing Practices and Attitudes in High–Risk Units," *Infection Control and Hospital Epidemiology*, Jul. 1991, vol. 12, No. 7.

Daschner, F.D., "Useful and Useless Hygienic Techniques in Intensive Care Units," *Intensive Care Medicine*, 1985.

Fox, Marian K.; Langner, Suzanne B.; Wells, Robin W.; "How Good Are Hand Washing Practices?, " *American Journal of Nursing*, Sep. 1974, vol. 74, No. 9.

Mayer, Joni A.; Dubbert, Patricia M.; Miller, Mary; Burkett, Paul A.; Chapman, Stanley W., "Increasing Handwashing in an Intensive Care Unit," *Infection Control*, 1986, vol. 7, No. 5.

Marcil, William M., "Handwashing Practices Among Occupational Therapy Personnel," *The American Journal of Occupational Therapy*, Jun. 1993, Vo. 47, No. 6.

*Primary Examiner*—Gregory L. Huson
*Attorney, Agent, or Firm*—Cesari and McKenna, LLP

[57] ABSTRACT

A unit suitable for wall mounting contains a supply of disinfectant and a proximity detector that senses an individual's approach. When an approaching individual is detected, the unit issues a visual and/or audible reminder to disinfect. A second proximity detector senses the presence of an individual's hands beneath a disinfectant ejection outlet, and the unit thereupon dispenses a predetermined amount of disinfectant. The invention may display compliance information including a compliance rate based on the ratio of alarms to actual dispensations of disinfectant, and may store historical compliance information for subsequent analysis.

18 Claims, 4 Drawing Sheets

AUTOMATED DISPENSER FOR DISINFECTANT WITH PROXIMITY SENSOR

BACKGROUND OF THE INVENTION

1. Field of the Invention

This invention relates generally to liquid-dispensing apparatus, and in particular to an automated disinfectant dispenser for use in health-care environments such as hospitals and nursing homes, as well as within the food-handling industry.

2. Description of the Related Art

Hospital-acquired (nosocomial) infections are a persistent source of treatment complication in acute-care and long-term care facilities. The danger presented by such infections grows with the increasing proportion of older, vulnerable patients populating such facilities and the emergence of antibiotic-resistant strains of bacteria. One estimate places the rate of infection in hospitals at about 5.7%, affecting about 2.1 million of the 37.7 million hospital patients admitted each year (Swartz, 91 *Proc. Natl. Acad. Sci. USA* 2420 [1994]).

Most nosocomial infections are spread by health-care workers' hands. Although proper washing has been shown to significantly reduce the carriage of potential pathogens on the hands (Steer et al., 83 *Ann. Intern. Med.* 683 [1990]; Garner et al., 7. *Infect. Control* 231 [1986]), hospital personnel frequently ignore disinfection guidelines (Goldmann et al., 327 *New Eng. J. Med.* 120 [1992]).

The reasons for noncompliance are probably as numerous as the difficult and distracting circumstances that arise in a busy health-care environment. At least part of the problem, however, stems from inconvenience, inadequate facilities and the lack of timely reminders. Particularly when hospital personnel make sequential stops along a patient corridor, it is probably unrealistic to expect them to interrupt room-to-room travel with trips to a central washing facility, even if its location is well chosen.

DESCRIPTION OF THE INVENTION

Brief Summary of the Invention

The present invention combines a convenient source of disinfectant with a perceivable reminder to health-care personnel, as well as visitors, to disinfect their hands at appropriate times. Essentially, the invention is a wall-mounted unit containing a supply of disinfectant and a proximity detector that senses the approach of an individual. When placed outside the door to each room of a hospital, or beside the bed of each patient in a multiple-bed room, the invention issues a visual and/or audible reminder (preferably selectable at the discretion of the operator) before the approaching person makes contact with the patient, but only in cirumstances where such contact is likely; in other words, when combined with proper unit placement, the proximity detector serves to minimize false alarms.

The preferred implementation of the invention includes a second proximity detector that senses the presence of an individual's hands beneath a disinfectant ejection outlet, whereupon the device dispenses a predetermined amount of disinfectant. In this way, the health-care worker's experience is entirely passive; he or she need not expend any effort to obtain disinfectant, effort that might discourage use of the disinfection facility. Furthermore, since contact with the dispenser is unnecessary, health-care workers will not inadvertently contaminate the invention by touching it.

Preferably, the invention displays compliance information that serves to encourage disinfection by health-care personnel and indicate effectiveness to supervisors. This information is displayed digitally, and includes a compliance rate based on the ratio of alarms to actual dispensations of disinfectant; in other words, noncompliance is assumed when a proximity alarm is not followed by disinfection. The invention preferably displays a daily compliance rate as well as a weekly rate, and can store historical compliance information for subsequent analysis. The invention can be configured to telemetrically communicate data to a central location (e.g., a nursing station) for analysis and feedback purposes. The invention can also include means for prohibiting rapid, repeated dispensing of disinfectant to manipulate reported compliance rates.

BRIEF DESCRIPTION OF THE DRAWINGS

The ensuing description of the invention will be understood more readily from the accompanying drawings, in which.

DETAILED DESCRIPTION OF THE PREFERRED EMBODIMENT

Figure 1:
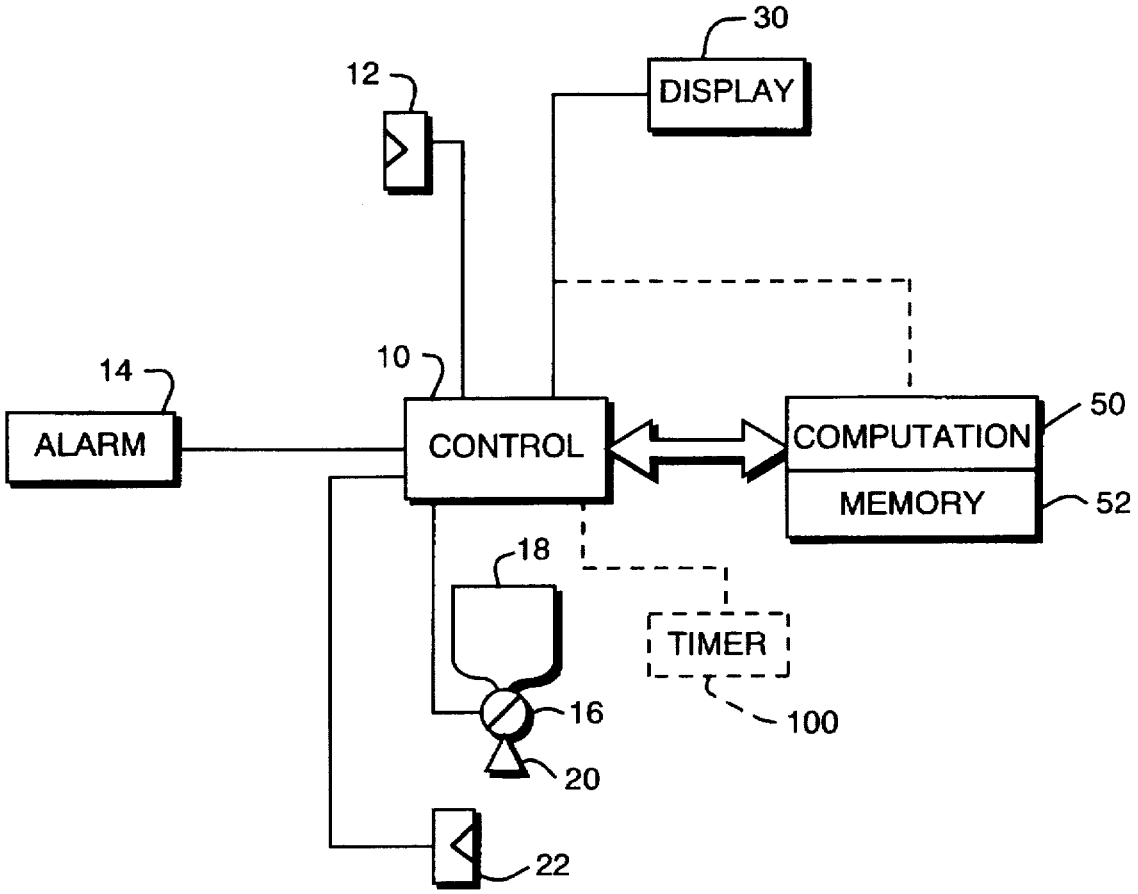
FIG. 1 schematically illustrates the primary components of the invention.

Refer first to FIG. 1, which shows the primary components of the invention and their manner of interaction. Operation of the various components is orchestrated by a control module 10, the nature and functions of which are described in the ensuing discussion. Operably connected to controller 10 are a proximity detector 12, which registers and produces an electronic trigger signal in response to a person's approach; an alarm 14, actuated by controller 10 in response to the trigger signal from detector 12; a controllable dispensing valve 16, interposed between a receptacle 18 for containing a liquid and an outlet spout 20; a second proximity detector 22, which senses the presence of a person's hands beneath spout 20 and enables actuation of valve 16; and a display 30 which, as discussed further below, may contain multiple display elements. Power for these components is supplied via controller 10.

Proximity detector 12 comprises any suitable arrangement for detecting the approach of a person. Preferably, detector 12 has a relatively short range, on the order of 12–14 inches. This is because the unit is primarily intended to be mounted in the corridor of a health-care facility, and should be triggered only by persons actually entering the room with which the unit is associated—not individuals merely passing by the room. Suitable detector arrangements are well-characterized in the art. In one approach, a beam of infrared ("IR") radiation is emitted (e.g., by an infrared light-emitting diode, or "LED") into a target region, and an optoelectronic IR sensor (e.g., a photo-diode) produces a signal (which may be amplified by appropriate circuitry within controller 10) indicative of the amount of IR reflected by, for example, an approaching person. The nearer a person approaches, the greater will be the amount of reflected IR.

Conventional filter circuitry limits initiation of the trigger signal to IR levels indicative of a person within the desired distance range. An advantage of this design is that the beam can be restricted to within a target region—e.g., immediately adjacent the door to a patient's room.

An alternative to the foregoing approach is a passive IR arrangement, whereby an IR sensor constantly monitors the ambient level of IR in its immediate vicinity. Sufficient elevation of this level above a background baseline indicates the approach of a person, and once again filter circuitry can be employed to restrict triggering of the alarm signal to conditions corresponding to the presence of a person within the target region.

Electromagnetic detectors provide another alternative to these approaches. This type of detector treats the target region as part of the dielectric of a capacitor. Typically, the output of a frequency generator runs through the capacitive circuit, and sufficient change in the observed frequency indicate the presence of a person within the target region.

Finally, it is possible to utilize arrangements whereby an acoustic (e.g., ultrasound) signal is emitted into the target region, and its return analyzed by suitable detection circuitry. As in the passive IR system, the magnitude of the return signal indicates the proximity of an approaching person.

Alarm 14 can be any arrangement suitable for capturing the attention of an individual in the target region; because the invention is intended for use in active, sometimes chaotic environments and at multiple neighboring sites, a non-disruptive form of alarm is preferred. In one approach, illustrated in FIG. 2, the alarm is a steady or blinking red light 32 or an LED statement such as Please Disinfect Hands. In another approach, the alarm is a soft but audible signal emitted through a loudspeaker 34. The signal may be a continuous tone, an intermittent tone, or a recorded voice issuing a reminder to disinfect. Controller 10 resets the alarm following actuation of dispensing valve 16, or after expiration of a predetermined elapsed time following the alarm-trigger signal.

Detector 22 can also take the form of an IR, acoustic or electromagnetic device as discussed above. However, since the target region beneath spout 20 is small and confined, a simple switching arrangement—which detects the presence or absence of a hand, rather than its range—may be utilized instead. For example, a detector 22 may be a photocell arrangement whereby a beam of light crosses a point below spout 20 and is intercepted by a photocell; interruption of the beam by a user's hand produces a trigger signal that causes controller 10 to open valve 16 and dispense a predetermined volume of liquid.

Figure 2:
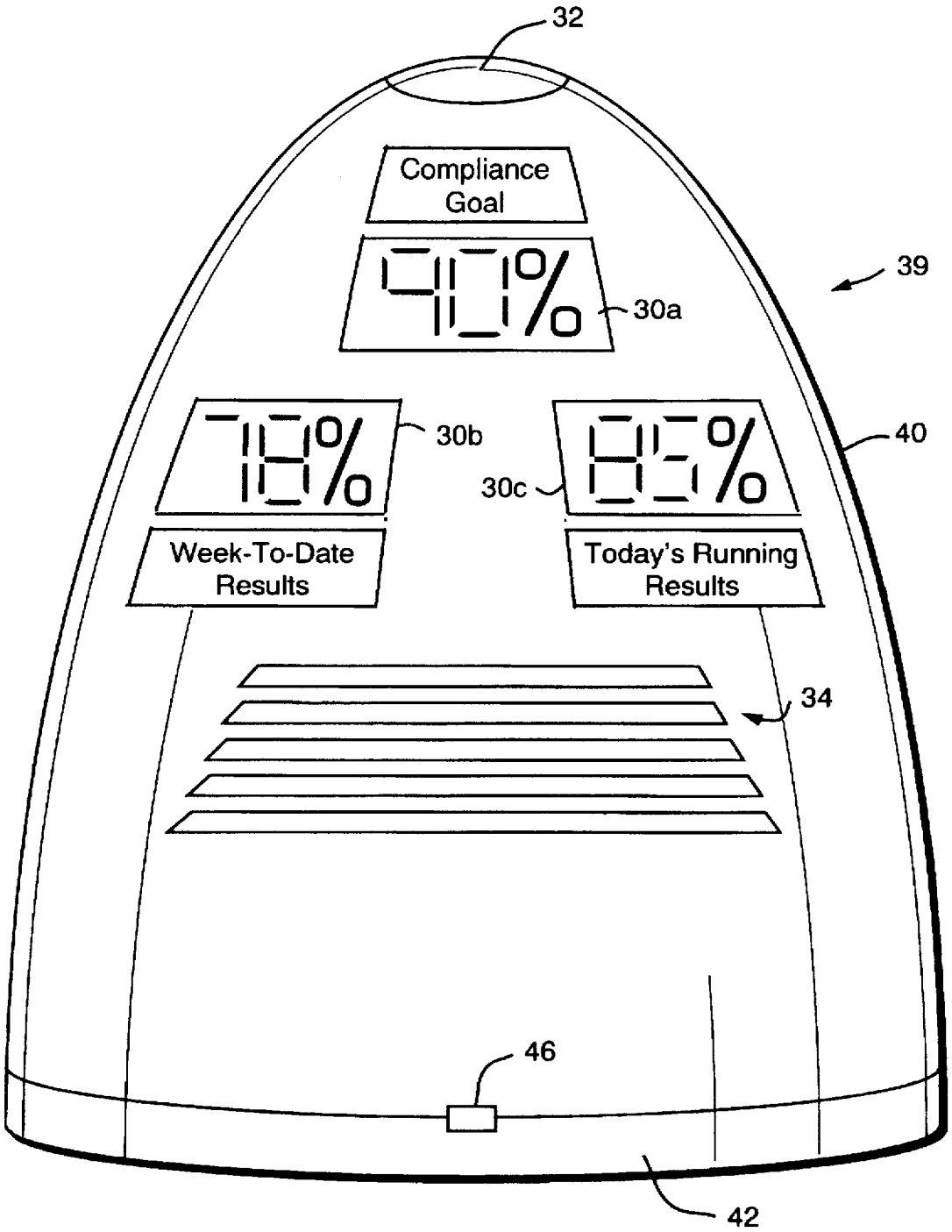
FIG. 2 is an elevational view of the invention from the front.

FIG. 2 illustrates the preferred construction of the overall unit. The components shown in FIG. 1 are all contained within (or associated with) a sturdy housing 39 comprising a curved front wall 40 having a partially ellipsoid shape, a base 42 and a rear plate 44 (see FIG. 4A). Rear plate 44 includes means, not shown, enabling the unit to be secured to a wall or other mounting surface. Front wall 40 pivots about a hinge 46 so that it may be drawn down, exposing the components contained therein and supported on base 42, and facilitating replacement or refilling of receptacle 18 (and, if the unit is to be powered by batteries, replacement of these as well). As shown in FIG. 2, a preferred form of display 30 includes three numeric readouts **30*a*, 30*b*, 30*c* each providing different but related information. All are driven by suitable digital circuitry in controller 10. Readout 30*a* indicates a compliance goal, and the displayed figure is arbitrarily set by supervisory personnel (e.g., by a keypad associated with controller 10 and contained within the unit housing 39). Readouts 30*b* and 30*c*** provide information regarding actual compliance as determined by operation of the unit.

In particular, each time proximity detector 12 senses a person's approach, controller 10 increments a first counter (e.g., a data register) within a computation module 50; and each time valve 16 is actuated, controller 10 increments a second counter within computation module 50. Module 50 computes a compliance rate by dividing the numeric contents of the second counter by the first counter, and controller 10 causes the result to be displayed in percentage terms on readout **30*c*. This computation is performed, and the contents of readout 30*c*** updated, each time either counter is incremented. Eventually, after a fixed interval (or at the discretion of health-care personnel, e.g., when a new patient is admitted to a room), the counters are reset to zero.

Preferably, however, the counter data are not discarded. Associated with computation module 50 is a memory circuit 52, which additively stores (i.e., accumulates) the contents of the first and second counters in separate memory cells when the counters are reset. Memory circuit 52 thereby retains data representing a cumulative compliance rate over a period of time longer than the counter reset interval. Computation module 50 utilizes the cumulative data and computes a new long-term compliance rate each time the counters are reset, and controller 10 causes the results of this calculation to be displayed on readout **30*b*. Typically, the counters are reset once each day, and the memory circuit cleared (and readout 30*b* reset to zero) once each week. However, memory circuit 52 can be configured to retain, for archival purposes, cumulative results over longer periods than are displayed on readout 30*b***.

The functions of controller 10 and computation module 50 are preferably performed by a suitably programmed microprocessor, which communicates directly with an associated computer memory. All of the control and computation operations heretofore described are readily implemented on standard microcomputer equipment without undue experimentation.

It should also be emphasized that computation module 50 and/or memory circuit 52 need not reside in housing 39. Instead, using suitable transmission circuitry, the output of controller 10 can be dispatched to a remote, central location that receives data from other simultaneously operative units. The functions performed at the central location can range from analysis of data received from multiple units to complete computational management of each unit; in the latter case, a computer independently processes data received from the various units and returns signals that drive each unit's display.

Figure 3:
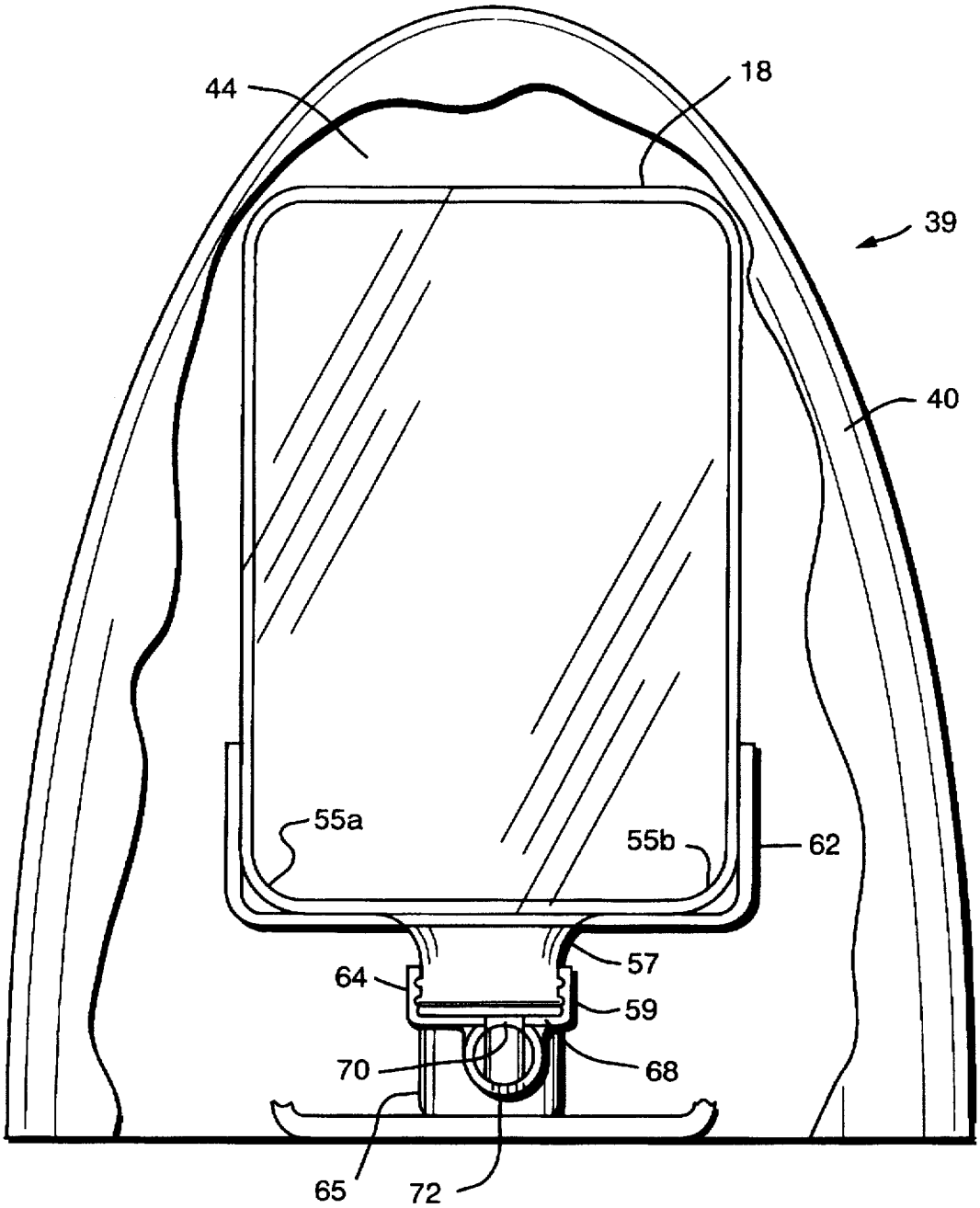
FIG. 3 is a cutaway depiction of the view shown in FIG. 2, illustrating some of the interior components of the invention.

Refer now to FIG. 3, which illustrates the manner in which receptacle 18 is retained within the housing 39 and its contents made available. Receptacle 18 holds a supply of liquid to be dispensed. Preferably, this liquid is an antimicrobial disinfectant (such as, for example, the CAL STAT product supplied by the ConvaTec division of Bristol-Myers Squibb), a small volume of which is capable of adequately disinfecting an individual's hands. Receptacle 18 preferably has a round cross-section to eliminate the need for precise orientation within housing 39, and a volume of at least 1 liter; the pouring end of receptacle 18 has a pair of curved shoulders **55*a*, 55*b* and a neck 57 that terminates in at least one lip or flange 59 that surrounds the orifice of receptacle 18. Secured within housing 39 is a bracket assembly 62 that snugly retains shoulders 55***a*, 55*b* of receptacle 18. A well 64 within a dispensing and support structure 65 receives the open end of receptacle 18 and contains grooves complementary to flange 59, such that introduction of receptacle 18 into bracket assembly 62 results in a "snap-fit" of flange 59 within well 64. An O-ring can be used to seal the orifice of receptacle 18 against the interior of well 64.

A variety of approaches can be utilized to prevent spillage of the contents of receptacle 18 during its installation. In the preferred approach, structure 65 is fully removable from base 42; flange 59 can then be snapped into well 64 and the entire assembly replaced. Alternatively, well 64 can contain a spike that pierces a seal over the orifice of receptacle 18 when the latter component is introduced into well 64; the seal may also function to preserve the contents of receptacle 18 from contamination, and to confirm their purity prior to initial use.

Figure 4A:
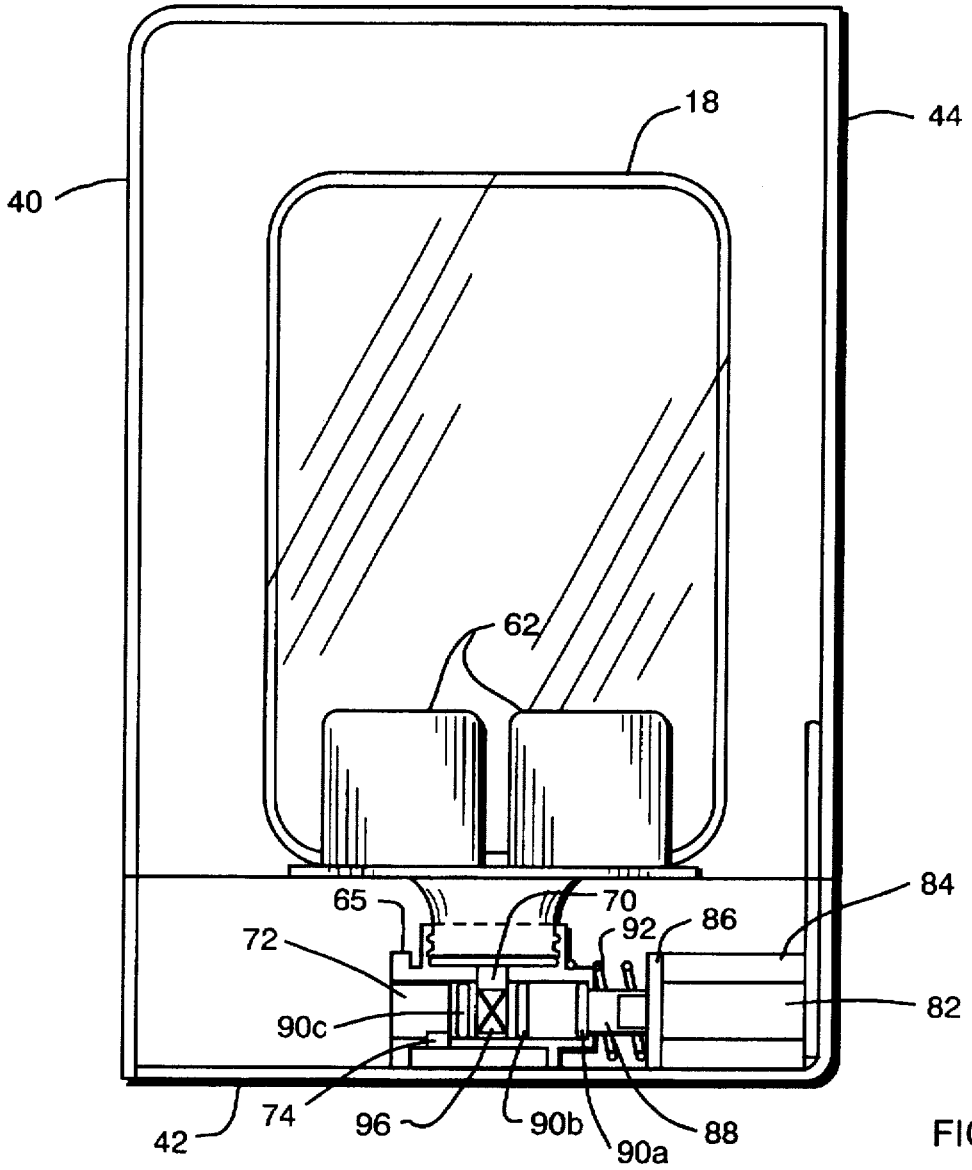
FIGS. 4A and 4B are side elevational sections illustrating the components and operation of a preferred form of dispensing valve.
Figure 4B:
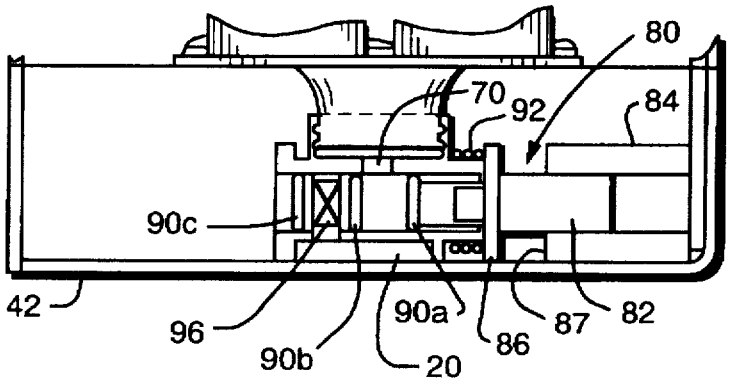

Well 64 has a floor 68 and a central aperture 70 therethrough. Aperture 70 leads into a cylindrical bore 72 extending through structure 65 underneath well 64. As shown in FIGS. 4A and 4B, bore 72 is part of a preferred form of selectably actuable dispensing valve 16. An aperture 74 extends through the bottom of bore 72 at a point axially offset with respect to aperture 70, and leads through the underside of housing 39 into spout 20 (or can itself serve as the spout). Accordingly, hands placed under aperture 74 receive liquid flowing therethrough.

A solenoid armature 80 (see FIG. 4B) comprises a shaft 82 that passes through a solenoid 84 and terminates in a face plate 86 that rests against the end face 87 of solenoid 84 when the latter is not energized. Solenoid 84 is operated by controller 10 in the manner described below. Attached to face plate 86 and forming part of armature 80 is a piston 88 having three cylindrical seals 90*a*, 90*b*, 90*c* which ride along the inner surface of bore 72 when armature 80 is reciprocated. A spring 92 is biased against the action of solenoid 84, and urges armature 80 back to its rest position with face plate 86 against end face 87 of solenoid 84. A hollow 96 extends transversely fully through piston 88 between cylindrical seals 90*b* and 90*c*, forming a liquid reservoir; the seals prevent liquid from escaping into bore 72. The volume of hollow 96 is selected so as to contain an amount of liquid adequate to disinfect an individual's hands; piston 88 can be configured to accommodate interchangeable reservoirs to accommodate different types of disinfectant.

In the rest position, shown in FIG. 4A, hollow 96 aligns with aperture 70 so that liquid from receptacle 18 fills hollow 96. Energizing solenoid 84 slides armature 80 into a dispensing position with hollow 96 positioned over aperture 74, thereby releasing its contents onto the user's hands. A small aperture (not shown) through structure 65 above the dispensing position of hollow 96 vents the reservoir and facilitates gravity flow. As armature 80 is retracted, hollow 96 realigns with aperture 70 in a sufficiently gradual manner to allow air within hollow 96 to escape into receptacle 18 and admit liquid into the hollow. Controller 10 energizes solenoid 84 by means of a solenoid driver, which may be any conventional device such as a darlington pair or a power field-effect transistor, which controller 10 activates only after receiving a valve-actuation signal from detector 22.

It is also .possible to eliminate the need for spring 92 by utilizing a dual-action solenoid, whereby retraction of armature 80 is accomplished by reversing the flow of energizing current.

In an alternative embodiment, dispensing valve 16 is a simple, electronically controllable flow valve whose outlet leads through the underside of housing 39 to spout 20. An appropriate volume of liquid is allowed to pass from receptacle 18 to the user's hands by holding the valve open for a suitable period of time. To this end, a timer 100 is associated with controller 10. Upon receipt of an actuation signal from detector 22, controller 10 opens valve 16 and initiates timer 100, closing valve 16 when timer 100 reaches its preset limit.

Thus, it will be seen that we have provided an automated dispensing apparatus uniquely suited to health-care and food-handling environments. The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Automated dispensing apparatus comprising:

a. a housing;

b. contained within the housing, a receptacle for liquid;

c. outlet means for conducting liquid from the receptacle to a dispensing location accessible to a user's hands;

d. a first detector for producing an alarm-trigger signal in response to the presence of a user proximate to the housing;

e. alarm means for generating, in response to the alarm-trigger signal, a user perceivable alarm;

f. a second detector for producing a valve-actuation signal in response to the presence of a user's hands in the dispensing location; and g. a dispensing valve, interposed between the receptacle and the outlet means, for sending a predetermined volume of liquid through the outlet means in response to the valve-actuation signal.

2. The apparatus of claim 1 wherein the alarm comprises a visible signal.

3. The apparatus of claim 1 wherein the alarm comprises an audible signal.

4. The apparatus of claim 1 wherein the dispensing valve comprises:

a. a reservoir for accepting a volume of liquid from the receptacle;

b. means for moving the reservoir into a fill position whereby liquid from the receptacle fills the reservoir; and c. means for moving the reservoir, in response to the valve-actuation signal, into a dispensing position whereby liquid from the reservoir passes through the outlet means.

5. The apparatus of claim 4 wherein the means for moving the reservoir into the dispensing position comprises a solenoid, and the means for moving the reservoir into the fill position comprises a spring biased against the solenoid.

6. The apparatus of claim 4 wherein both means for moving the reservoir comprise a single dual-action solenoid.

7. The apparatus of claim 1 wherein the dispensing valve comprises a timer-operated flow valve.

8. The apparatus of claim 1 further comprising:

a. means for counting actuations of the alarm;

b. means for counting actuations of the dispensing valve; and c. means for reporting a compliance rate based on the ratio of alarm actuations to dispensing-valve actuations.

9. The apparatus of claim 1 further comprising reset means for terminating the alarm in response to at least one of (i) expiration of a predetermined elapsed time following the alarm-trigger signal, and (ii) actuation of the dispensing valve.

10. The apparatus of claim 1 further comprising a supply of antimicrobial disinfectant within the receptacle.

11. A method of controllably dispensing a liquid, the method comprising:

a. providing a receptacle containing a liquid and an outlet to the receptacle;

b. providing means for dispensing a predetermined amount of the liquid through the outlet;

c. sensing the proximity of a user to the receptacle and generating, in response thereto, a user-perceivable alarm; and d. sensing the presence of a user's hands proximate to the outlet and, in response thereto, dispensing the predetermined amount of the liquid through the outlet.

12. The method of claim 11 wherein the liquid is an antimicrobial disinfectant.

13. The method of claim 11 wherein the alarm comprises a visible signal.

14. The method of claim 11 wherein the alarm comprises an audible signal.

15. The method of claim 11 further comprising the steps of:

a. counting actuations of the alarm;

b. counting actuations of the dispensing valve; and c. reporting a compliance rate based on the ratio of alarm actuations to dispensing-valve actuations.

16. The method of claim 11 further comprising the step of resetting the alarm in response to at least one of (i) persistence of the alarm for a predetermined time and (ii) dispensation of the predetermined amount of liquid through the outlet.

17. The method of claim 15 further comprising the step of storing storing a plurality of compliance rates in a memory circuit.

18. The method of claim 15 further comprising the step of transmitting the compliance rate to central location.

* * * * *